US007635049B2

(12) United States Patent
Van Der Meijden et al.

(10) Patent No.: US 7,635,049 B2
(45) Date of Patent: Dec. 22, 2009

(54) METHOD AND APPARATUS FOR INSTALLING AN ELEVATOR DURING THE CONSTRUCTION OF A BUILDING

(75) Inventors: Gert Van Der Meijden, BV Otterlo (NL); Jos Van Den Heuvel, NN's-Hertogenbosch (NL)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/042,050

(22) Filed: Jan. 26, 2005

(65) Prior Publication Data

US 2005/0150728 A1 Jul. 14, 2005

Related U.S. Application Data

(63) Continuation of application No. PCT/FI03/00903, filed on Nov. 26, 2003.

(30) Foreign Application Priority Data

Dec. 2, 2002 (FI) ..... 20022122

(51) Int. Cl.
*B66B 11/02* (2006.01)

(52) U.S. Cl. ..... 187/401; 187/900

(58) Field of Classification Search ..... 187/254, 187/411, 401, 900
See application file for complete search history.

(56) References Cited

U.S. PATENT DOCUMENTS

| | | | | | |
|---|---|---|---|---|---|
| 3,298,462 | A | * | 1/1967 | Morris | 187/262 |
| 3,519,101 | A | * | 7/1970 | Sieffert | 187/256 |
| 3,614,994 | A | * | 10/1971 | Goodrum | 187/406 |
| 3,759,349 | A | | 9/1973 | Sieffert | |

FOREIGN PATENT DOCUMENTS

| | | | |
|---|---|---|---|
| FR | 2694279 | A1 * | 2/1994 |
| JP | 54108331 | A * | 8/1979 |
| JP | 7-237847 | A | 9/1995 |

* cited by examiner

*Primary Examiner*—John Q. Nguyen
*Assistant Examiner*—Eric Pico
(74) *Attorney, Agent, or Firm*—Birch, Stewart, Kolasch & Birch, LLP

(57) ABSTRACT

The invention also relates to a method for installing an elevator provided with a machine room and suspended by hoisting ropes (15) and moving along guide rails (2) during the construction stage of building. The elevator is provided with a hoisting device (17), by means of which the machine room (4), which is initially placed in the lower part of the elevator shaft (1), is lifted through one or more floor-to-floor distances at a time in the shaft in such manner that at least the vertical forces resulting from the lifting are transmitted to the bottom structures of the building substantially via the guide rails (2) already secured.

11 Claims, 2 Drawing Sheets

Figure 1:
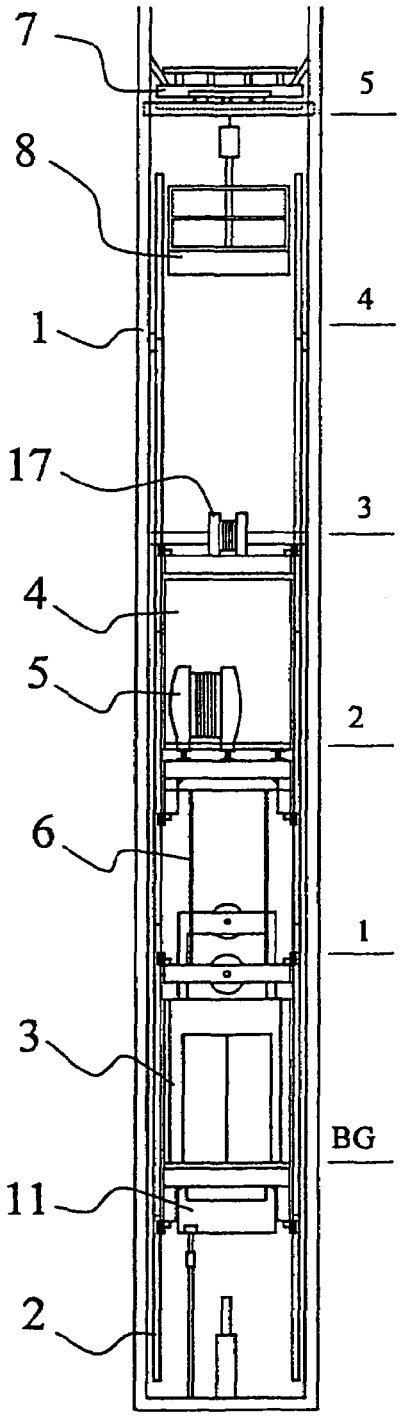

METHOD AND APPARATUS FOR INSTALLING AN ELEVATOR DURING THE CONSTRUCTION OF A BUILDING

This application is a Continuation of co-pending PCT International Application No. PCT/FI2003/000903 filed on Nov. 26, 2003, which designated the United States, and on which priority is claimed under 35 U.S.C. § 120, which claims priority under 35 U.S.C. § 119(a) on Patent Application No(s). 20022122 filed in Finland on Dec. 2, 2002, the entire contents of which are hereby incorporated by reference.

The present invention relates to a method as defined in the preamble of claim 1 and to an apparatus as defined in the preamble of claim 6 for installing an elevator during construction of a building.

In high-rise buildings, elevators are often needed during the construction stage before the building has been completed. Elevators are needed e.g. for construction-time use to allow the constructors to reach as high levels in the building as possible by elevator. Similarly, when the lower floors of a building are completed before the upper floors, the elevators must be available for use by the people already using the completed floors. As the construction work is progressing, the elevators have to be able to serve floors as high up as possible.

A prior-art solution for this type of construction-time use is the so-called jump-lift, wherein the hoisting height of the elevator is increased in steps of one or more floor levels each time when the construction work has reached a sufficient height relative to the previous jump. The elevator machine room is removed upwards by the above-mentioned number of floors and all the components dependent on the hoisting height, such as car cables, overspeed governor ropes and other components mounted in the shaft, electric equipment in the shaft, shaft cables, compensation ropes etc. are extended to cover the height of the entire completed shaft.

In prior art, the machine room has been lifted by using the building's own construction hoist, among other things. The problem in this case is that the elevator installation is dependent on the use of the construction hoist. The construction hoist may be needed elsewhere on the building site at the same time, in which case the hoist will not be available for use at the desired time or for a time long enough. Likewise, it may be very difficult to get an opportunity to utilize the construction hoist for temporary needs.

Another prior-art solution for the installation of an elevator is disclosed in PCT specification no. WO00/07923, wherein, instead of utilizing the construction hoist, the elevator machine room is lifted one level at a time by utilizing a thrust platform and lifting cylinders or equivalent. A problem with this solution is that the thrust platform and the machine room are secured to the floors of the building already during construction time. A group consisting of several elevators may have a total weight of several thousands of kilograms, which is a load too big and risky for floors still partly unfinished. For example, the ceiling between the elevators in a four-elevator group is relatively weak and can not withstand such loads. Another problem is that the constructor may have to make extra openings in the structures to accommodate installation-time reinforcements. A further problem with this solution is that the machine room can only be lifted one floor-to-floor distance at a time, which means that each lifting operation always involves the same additional preparatory arrangements and work, which together require plenty of extra construction time.

The object of the present invention is to overcome the above-mentioned drawbacks and to facilitate and accelerate construction-time elevator installation by providing an economical and reliable method for construction-time installation of an elevator that is easy and simple to implement. An additional object is to achieve an apparatus for enabling construction-time installation of an elevator.

The method of the invention for construction-time installation of an elevator is characterized by what is disclosed in the characterization part of claim 1, and the apparatus for construction-time installation of an elevator is characterized by what is disclosed in the characterization part of claim 6. Other embodiments of the invention are characterized by what is disclosed in the other claims.

By applying the invention, one or more the following advantages can be achieved, among others:

- installation of the elevator can be started at a very early stage of construction
- the elevator machine room and all the equipment are lifted using a separate lifting arrangement developed for the elevator
- the construction hoist of the building is not needed, and thus other construction work is not disturbed or retarded
- elevator installation is independent of the use of the building crane
- the machine room need not be supported on the walls of the elevator shaft or on the intermediate floor slabs
- all or at least part of the weight of the machine room, elevator car and counterweight can be borne by the elevator guide rails during elevator installation
- elevator installation produces no extra loads on the walls and intermediate floor slabs
- no extra openings and reinforcements for elevator installation need to be made in the concrete structures of the building
- the invention enables a transportation capacity and logistics utilization at least four times better than in prior-art construction-time elevators
- allows savings in time by constructors and sub-contractors and leads to faster completion of the building project
- less work needed for lifting the machine room
- elevator installation times are shortened and the total installation costs reduced
- safer installation environment
- finished floors are ready for normal elevator operation very soon after their completion
- the façade of the building can be finished earlier than normal
- lower energy consumption than in prior-art techniques
- less space is needed outside the building
- easy to establish as a standard installation method.

Figure 2:
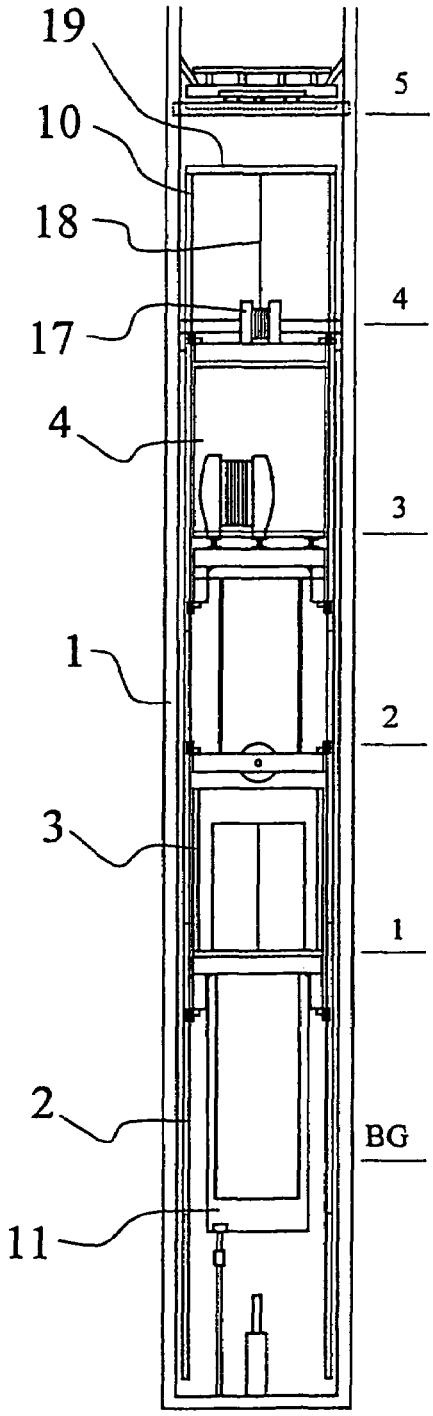
Figure 3:
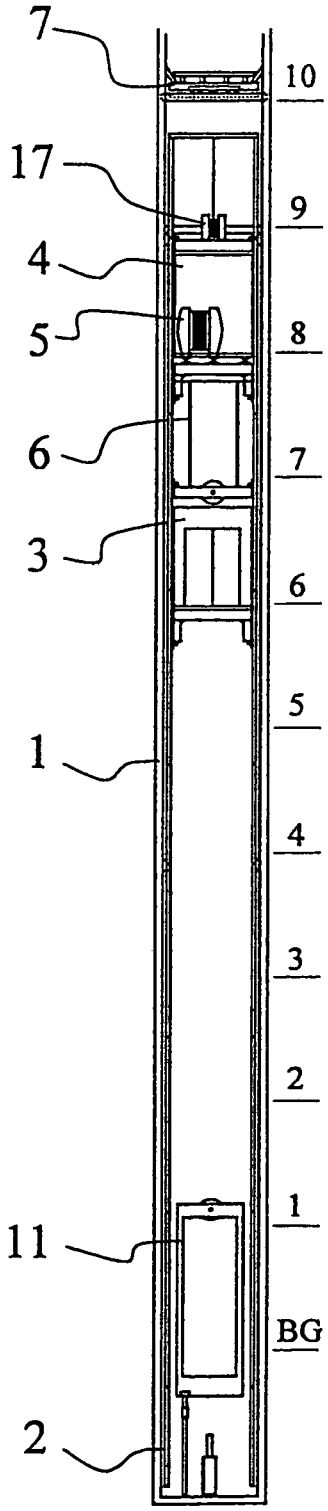
Figure 4:
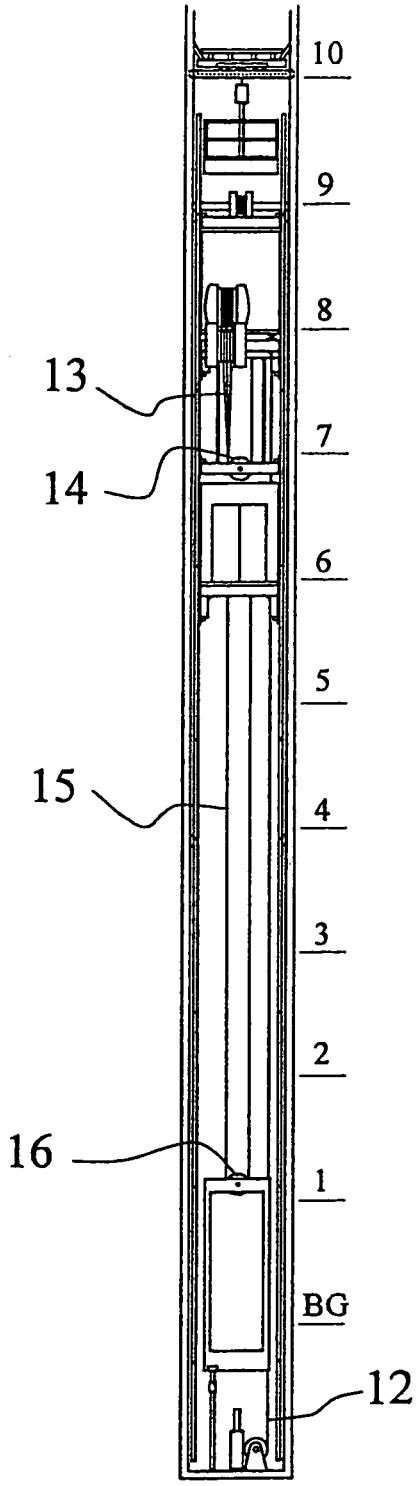

In the following, the invention will be described in detail by the aid of an embodiment example with reference to the attached drawings, wherein FIG. 1 presents a diagrammatic front view of an elevator installation situation according to the invention where the elevator car has already been installed on the foundation floor, FIG. 2 presents a diagrammatic front view of an elevator installation situation according to the invention where the elevator car has been lifted to the first floor, FIG. 3 presents a diagrammatic front view of an elevator installation situation according to the invention where a jump lift has been carried out and the elevator car has been lifted to the sixth floor, and FIG. 4 presents a diagrammatic front view of an elevator installation according to the invention where a jump lift has been carried out and the elevator hoisting ropes as well as the overspeed governor rope have been installed at this height.

According to the method of the invention, the main steps of the elevator installation process are as follows. After the constructor has first mounted in the shaft 1 a movable and waterproof supporting platform 7, which is secured to the floor slab of e.g. the fifth floor, the actual elevator installation work is started. First, a working platform 8 and an auxiliary hoist for the hoisting of elevator components are secured to the supporting platform 7. Furthermore, the working platform 8 is provided with slide shoes by means of which the working platform is guided by the elevator guide rails. After this, in the actual first stage of installation, the elevator guide rails 2 and the counterweight guide rails, the latter being omitted from the figures for the sake of clarity, are secured to the lower part of the shaft 1. During this stage, five guide bars are mounted one above the other, of which the bottommost and the topmost guide bars 10 are shorter than the other three bars, which are of equal length. With normal floor height, the guide rails now extend nearly to the height of the fifth floor.

In a second stage of the installation process, the frame of the counter-weight 11, the landing doors as well as the lighting and electrification of the shaft are installed up to a level as high as possible at this stage. In the example, the equipment is installed up to the level of the fifth floor.

In a third stage of installation, a temporary frame is built for the elevator machine room 4, and the machine room together with a hoisting machine 5 and a control panel is mounted in this frame and placed on the foundation floor of the elevator. At the same time, an overspeed governor is installed in the machine room and likewise a hoist 17 serving as a lifting means, by means of which the future jump lifts are to be performed. The hoisting points for the hoisting rope 18 or equivalent of the hoist are secured to the upper ends of the elevator guide rails by means of a special, easily releasable securing structure 19 designed for this purpose. The hoist 17 itself is well secured to the machine room and it is used to pull the machine room upwards in connection with a jump lift by means of the hoisting rope or equivalent supported by the upper ends of the elevator guide rails. If the working platform 8 is an obstruction to movement of the securing structure 19, it can be removed to a suitable place for the time it takes to perform the jump lift.

FIG. 1 illustrates a fourth stage of installation, wherein the machine room 4 has been lifted to the level of the second floor and the elevator car 3 is installed in the shaft on the foundation floor by building a car frame and securing the wall, ceiling and floor elements of the car to each other and to the car frame. At this stage, the electrification of the car can also be implemented. Moreover, the car is provided with a door and the finishing of the car is completed. At this stage the elevator is also provided with a hoisting rope, which is as yet coiled on a rope drum. In connection with the fourth stage, the elevator car 3 is also connected to the machine room 4 e.g. by means of chains 6 to allow a jump lift.

In a fifth stage as illustrated by FIG. 2, the combination of machine room and elevator car is hoisted upwards through one floor-to-floor distance by means of the hoist 17 and the combination is secured to the elevator guide rails 2 already installed. At this stage also the currently topmost tie plate of the elevator guide rails is fixed firmly in place.

In a sixth stage of installation, the waterproof supporting platform 7 is raised five floors upwards for a future jump lift and secured to the floor slab. The installation process is now continued by mounting in the next five-floor section the required piping and electrical equipment as well as the elevator guide rails 2, counterweight guide rails and landing doors.

In a seventh stage as illustrated by FIG. 3, the actual jump lift is carried out. The elevator machine room 4 together with the elevator car 3 is pulled upwards through five floor-to-floor distances, the elevator car being thus lifted from the first floor level to the sixth floor level. The lifting is performed by means of the hoist 17, the lifting force being received by the supporting points at the upper ends of the elevator guide rails 2. Thus, the load resulting from the lifting is evenly distributed on the elevator guide rails 2, so the lifting does not produce any stress on the building's own structures, such as walls, intermediate floor slabs or elevator shaft walls. After the jump lift has been carried out, the combination of machine room and elevator car is secured uniformly to the elevator guide rails 2 already installed. In addition, the currently topmost tie plate of the elevator guide rails is again secured firmly in place.

FIG. 4 illustrates an eighth stage of installation, wherein the required roping is installed. The elevator ropes 13 are passed from the traction sheave of the machine 5 around the deflecting pulley 14 in the car frame to their fixing point, and similarly the counterweight ropes 15 are passed around a deflecting pulley 16 in the frame of the counterweight 11 to their fixing point. In addition, the overspeed governor rope 12 is installed. During this stage, the elevator is also balanced by adding the required weights to the counterweight frame. In addition, the required shaft components and switches are installed, whereupon the elevator is ready for inspection and operation within the six lowest floors.

In the next stage, the waterproof supporting platform 7 is again raised five floors upwards for a future jump lift and secured to the floor slab. The installation process is now continued through the next five floors upwards in a manner corresponding to the above-described-stages 6-8. The installation work is carried on by this method in jumps of five floors at a time, making the elevator ready for operation at levels higher and higher up in the building as the construction work progresses.

It is obvious to the person skilled in the art that different embodiments of the invention are not limited to the example described above, but that they may be varied within the scope of the claims presented below. In accordance with the examples described above, the skilled person may vary an embodiment of the invention e.g. by using a jump lift distance other than a five-floor distance as mentioned above. Depending on the circumstances, any distance equal to a floor height may be the most appropriate distance. Therefore, all floor-to-floor distances between 1 . . . 8 and suitably e.g. between 3 . . . 7 or between 4 . . . 6 may be mentioned.

It is also obvious to the skilled person that the order of different details of the installation method as well as the working method may vary. Likewise, the use and mode or operation of the hoist used for lifting the machine room may differ from the above description.

The invention claimed is:

1. A method for installing an elevator provided with a machine room, an elevator car and hoisting ropes, comprising the steps of:

securing car guide rails in a building during the construction stage;

initially placing the machine room on the car guide rails in the lower part of an elevator shaft;

mounting a hoisting device on the machine room;

connecting said hoisting device via a hoisting rope to a securing structure supported by and attached to upper ends of the car guide rails;

lifting the machine room along said car guide rails through one or more floor-to-floor distances at a time in the elevator shaft and securing said machine room to said car guide rails;

thereby transmitting forces resulting from lifting the machine room to bottom structures of the building substantially via the securing structure and the car guide rails.

2. The method according to claim 1, further comprising connecting the elevator car to the machine room and lifting the elevator car at the same time through a corresponding distance upwards.

3. The method according to claim 2, wherein the machine room and the elevator car are lifted through a distance corresponding to 1 . . . 8 floor-to-floor distances.

4. The method according to claim 3, wherein the machine room and the elevator car are lifted through a distance corresponding to 3 . . . 7 floor-to-floor distances.

5. The method according to claim 2, wherein, each time after the machine room and elevator car have been lifted, the machine room and elevator car are secured to the car guide rails, whereupon the securing structure of the hoisting device is released from the upper end of the car guide rails.

6. Apparatus for installing an elevator provided with a machine room, elevator car and hoisting ropes, comprising:

car guide rails secured in a building during the construction stage;

said machine room being secured to and movable on said car guide rails in a lower part of an elevator shaft;

a hoisting device mounted on said machine room for lifting said machine room;

said hoisting device being connected to a securing structure supported by and attached to upper ends of the car guide rails, wherein when the hoisting device lifts the machine room along said car guide rails through one or more floor-to-floor distances at a time in the elevator shaft, at least the vertical forces resulting from lifting the machine room are transmitted to bottom structures of the building substantially via the securing structure and the car guide rails.

7. The apparatus according to claim 6, wherein a hoisting rope connects said hoisting device to said securing structure.

8. The apparatus according to claim 7 wherein the length of the hoisting rope or equivalent of the hoisting device has been fitted to be such that the machine room can be lifted through at least 1 . . . 8 floor-to-floor distances at a time.

9. The method according to claim 8, wherein the machine room and the elevator car are connected and lifted through a distance corresponding to 5 floor-to-floor distances at a time.

10. The apparatus according to claim 6, wherein the hoisting device is connected to the upper ends of the car guide rails already installed by means of a releasable securing structure, which has been arranged to distribute the forces resulting from the lifting substantially evenly on the car guide rails.

11. The apparatus according to claim 6, wherein the elevator car is connected to the machine room such that the hoisting apparatus lifts both the machine room and the elevator car at the same time.

* * * * *